US009726362B2

(12) United States Patent
Rosen et al.

(10) Patent No.: US 9,726,362 B2
(45) Date of Patent: Aug. 8, 2017

(54) LED HEATER SYSTEM AND METHOD

(71) Applicant: VITEC VIDEOCOM INC., Chatsworth, CA (US)

(72) Inventors: Richard Allen Rosen, Simi Valley, CA (US); Joshua Alexander Forbes, Los Angeles, CA (US)

(73) Assignee: VITEC VIDEOCOM INC., Chatsworth, CA (US)

( * ) Notice: Subject to any disclaimer, the term of this patent is extended or adjusted under 35 U.S.C. 154(b) by 0 days.

(21) Appl. No.: 14/592,823

(22) Filed: Jan. 8, 2015

(65) Prior Publication Data

US 2015/0204533 A1 Jul. 23, 2015

Related U.S. Application Data

(60) Provisional application No. 61/924,934, filed on Jan. 8, 2014.

(51) Int. Cl.

| | |
|---|---|
| ***F21V 29/54*** | (2015.01) |
| ***F21V 29/00*** | (2015.01) |
| ***F21V 29/02*** | (2006.01) |
| ***F21V 29/67*** | (2015.01) |

(Continued)

(52) U.S. Cl.

CPC ..... *F21V 29/54* (2015.01); *F21K 9/20* (2016.08); *F21V 5/045* (2013.01); *F21V 29/006* (2013.01);

(Continued)

(58) Field of Classification Search

CPC ..... F21V 29/006; F21V 5/045; F21V 29/74; F21V 29/02; F21V 29/677; F21V 29/90; F21V 29/54; F21K 9/20; F21W 2131/406; F21W 2131/407; F21Y 2101/00

See application file for complete search history.

(56) References Cited

U.S. PATENT DOCUMENTS 6,352,358 B1 3/2002 Lieberman et al.
7,211,771 B1 * 5/2007 Smith ..... 116/202

(Continued)

FOREIGN PATENT DOCUMENTS

WO PCT/US2015/010689 3/2015

*Primary Examiner* — Bao Q Truong
(74) *Attorney, Agent, or Firm* — Gable Gotwals; Scott R. Zingerman

(57) ABSTRACT

The present disclosure includes an apparatus and method relating to LED fixtures having an LED module capable of operating at a temperature. The LED module is also capable of being operated within a desired temperature range having an upper limit and a lower limit. A fan is operable for cooling the LED module when the temperature of the LED module approaches the upper limit. A heater is operable for heating the LED module when the temperature of the LED module approaches the lower limit. A heat sink may be in thermal communication with the LED module such that the fan may cool and the heater may heat the heat sink. The controller may also be configured to selectively activate the heater and the fan. The controller may also be in electrical communication with a temperature sensor which is in thermal communication with the LED module such that the controller may read the temperature of the LED module. The controller may activate the fan and/or the heater depending on the temperature of the LED module.

11 Claims, 5 Drawing Sheets

(51) Int. Cl.

| | |
|---|---|
| ***F21V 29/74*** | (2015.01) |
| ***F21V 29/90*** | (2015.01) |
| ***F21V 5/04*** | (2006.01) |
| ***F21K 9/20*** | (2016.01) |
| *F21W 131/406* | (2006.01) |
| *F21W 131/407* | (2006.01) |
| *F21Y 115/10* | (2016.01) |

(52) U.S. Cl.

CPC ..... *F21V 29/02* (2013.01); *F21V 29/677* (2015.01); *F21V 29/74* (2015.01); *F21V 29/90* (2015.01); *F21W 2131/406* (2013.01); *F21W 2131/407* (2013.01); *F21Y 2115/10* (2016.08)

(56) References Cited

U.S. PATENT DOCUMENTS

| | | | | |
|---|---|---|---|---|
| 7,806,558 | B2 * | 10/2010 | Williamson | F21V 7/0091 362/237 |
| 8,563,898 | B1 * | 10/2013 | Wright | B60Q 1/0017 219/202 |
| 9,159,521 | B1 * | 10/2015 | Chen | F21V 7/0025 |
| 2005/0201088 | A1 * | 9/2005 | Stach | F21V 23/026 362/225 |
| 2005/0279949 | A1 * | 12/2005 | Oldham | F21K 9/00 250/458.1 |
| 2011/0261572 | A1 * | 10/2011 | Watanabe | F21V 19/001 362/373 |
| 2012/0318780 | A1 | 12/2012 | Juarez | |
| 2013/0114279 | A1 | 5/2013 | Marley | |

* cited by examiner

LED HEATER SYSTEM AND METHOD

CROSS REFERENCE TO RELATED APPLICATION

This application claims the benefit of U.S. Provisional Application No. 61/924,934 filed Jan. 8, 2014, herein incorporated by reference in its entirety for all purposes.

FIELD OF THE INVENTION

The present invention relates to LED based light fixtures. More particularly, but not by way of limitation, the present invention relates to a heater system for a high-power light emitting diode based light fixture.

BACKGROUND OF THE INVENTION

Generally speaking, light emitting diodes (LEDs) are finding their way into an ever increasing variety of light fixtures for an ever increasing number of applications. The popularity of LEDs has been driven by a number of factors, such as: a heightened awareness of the ecosystem spurred by the so called "climate change" debate; increased efficiency which can realize a rapid financial payback typically measured in months; exceptionally long bulb life compared to other lighting options; visually pleasing light quality; and an ever decreasing price in dollars per lumen of output. This list is not exhaustive and virtually every application for LED lighting will find advantages specific to the application.

LEDs offer significant advantages over every other known type of bulb. For example, LEDs produce at least four times the light produced by an incandescent bulb of the same wattage. However, if one measures harnessed light, the light actually striking an illuminated object, the LED typically delivers close to eight, sometimes as much as ten, times the light. This is due to the fact that the light from an LED is usually delivered conically rather than spherically, eliminating the need to reflect light headed toward the back of the fixture, an inherently inefficient process.

LEDs are also environmentally attractive compared to fluorescent lighting, or other gas discharge-types of lighting. While efficiencies of LEDs and gas discharge bulbs are similar, when measured in lumens per watt, harnessed light from LEDs is typically close to twice that of gas discharge-type bulbs. Further, LEDs have not reached their theoretical limit of efficiency, and indeed newer models continue to improve output, e.g., lumens per watt. In contrast, gas discharge bulbs are more fully evolved. In addition, gas discharge bulbs, including fluorescent tubes, use small amounts of mercury. There is growing concern over filling landfills with mercury. Admittedly, chemicals are used in the making of LEDs that may not be any less dangerous than mercury but: 1) LEDs are hermetically encapsulated so the chemicals will not find their way into the environment, unlike the glass envelope of gas discharge devices, which are easily broken during disposal; and 2) the bulb life of LEDs is significantly longer so radically fewer LED devices are finding their way into landfills in the first place.

In particular, LEDs are proving beneficial for all types of high-power lighting, such as street lights, parking lot lights, movie and television production lighting, theatre lighting, indoor high-bay lighting, projector lighting, and the like. There are many reasons for the switch to LEDs but in many of these applications fixtures are inaccessible and bulb life is of primary concern.

In the case of entertainment lighting, LEDs have proven themselves to render skin tones with exceptional accuracy, making the LED particularly useful for motion picture and television production. In addition, unlike gas discharge lamps, LEDs can easily be dimmed over their entire range of operation and, unlike incandescent bulbs, LEDs have only a small color temperature shift over the dimming range. Further, the absence of any significant amount of infrared radiation from LEDs means there is virtually no heat felt by the subject of the illumination.

These markets have created a demand for higher and higher wattage LEDs. For many years, the limiting factor for the power of an LED fixture was the ability to dissipate heat from the LEDs into the environment. Other types of lighting radiate most of the heat produced by the bulb as infrared energy. In contrast, LEDs produce virtually no infrared. While in many ways this is an advantage, i.e. people under the light do not get hot, in some ways it is a disadvantage: all of the heat from LEDs must be conducted away. Fixture designers must strive to keep the LED die at less than 85° C., excessive temperature results in significant reduction in the life of the LED and, in the case of white LEDs, premature failure of the phosphors. Many LEDs exhibit a permanent shift in color temperature toward warmer hues when the LED is operated above its rated temperature.

For smaller LEDs the limiting factor is the amount of heat that can be conducted away in the electrical leads. In higher power devices, a cooper or aluminum slug is placed behind the semiconductor die to help carry heat away from the device. This technology seems to reach a practical limit at about ten watts per device.

In response, a number of manufacturers have begun using known chip-on-board, or COB, technology, to place a large number of LED dies in a very small area. The LEDs are mounted on an aluminum or copper core board so that the heat can be effectively transferred to a heat sink. While modules in the thirty to 300 watt range are now fairly common, several manufacturers claim modules in excess of 1000 watts are possible with current technology. High power modules, particularly modules having an input power of 30 watts, or more, create new challenges for fixture designers as significant amounts of heat must be dissipated into the environment. While theoretically traditional aluminum heat sinks could be constructed to take advantage of convection cooling for any foreseeable power level, at some point the amount of aluminum required would be prohibitive from both a cost standpoint and a fixture-handling standpoint.

Already, LED fixtures incorporating high-power LED modules have turned to forced air cooling, typically using a conventional rotating fan. With increased air flow, smaller and lighter heat sinks can be used, far offsetting the additional cost of the fan. In applications where noise is an issue, fixture designers strive for laminar air flow and thermostatically controlled fans to minimize noise. Heat pipes, water cooling, as well as other exotic techniques have been used to extract the heat from the relative small area around the LED module and dissipate it in a much larger volume.

Unfortunately, problems still exist in the use of such high power modules, such as: white LEDs exhibit a slight color shift as the operating temperature changes; and COB modules survive only a limited number of thermal cycles. Color shift over changes in operating temperature is of particular concern in motion picture and television production. While the human eye will adjust to such changes, film and video are unforgiving. The process for fixing a color shift in post-production is costly and time consuming. Adding to the problems is, the larger the heat sink, the longer it will take the fixture to achieve a steady-state temperature. In an LED fixture, it is not uncommon to see a 15 to 45 minute delay in achieving steady-state.

With regard to temperature cycling, it has been observed that, where LED fixtures are used only a few hours a day, modules will predominantly fail from temperature cycling as opposed to failure of the die or the phosphor.

Thus it is an object of the present invention to provide a system and method to reduce the effect of temperature cycling on the color temperature of the emitted light and on the life of a high power module.

SUMMARY OF THE INVENTION

The present invention provides an LED based light fixture where the effects of temperature cycling are significantly diminished.

In one preferred embodiment an LED fixture is provided which includes a high power LED module, a heat sink in thermal communication with the module for dissipating the heat produced by the module into the environment, and a heater for warming the module when the LED is very dim or off.

In another preferred embodiment the inventive LED fixture further includes a fan for moving air over the heat sink to increase the rate at which heat is dissipated from the heatsink and where the fan can be turned off while the heater is operable to reduce the amount of heat needed to maintain the temperature of the LED module.

In still another preferred embodiment, a semiconductor, such as a MOSFET, is used to produce heat when the LED module is turned off.

In yet still another preferred embodiment a Peltier device is employed so that, when the LED is operable, current is driven through the Peltier device in a first direction to cool the module and deliver heat to the heatsink. When the LED is not operated, the current through the Peltier device is reversed so the LED is warmed and heat is brought into the fixture from the heatsink.

In a further embodiment, the present disclosure includes an LED fixture having a housing; a heat sink supported by the housing; an LED module in thermal communication with the heat sink; and a heater in thermal communication with the LED module wherein when the LED module is inactive, the heater can be driven to add heat to the LED module.

In yet a further embodiment, the present disclosure includes an LED fixture having an LED module capable of operating at a temperature; the LED module capable of being operated at least within a desired temperature range having an upper limit and a lower limit; a fan operable to cool the LED module when the temperature of the LED module approaches the upper limit; and, a heater operable to heat the LED module when the temperature of the LED module approaches the lower limit. A heat sink may be in thermal communication with the LED module. A controller may be configured to selectively activate the heater and the fan. A controller may be in electrical communication with a temperature sensor which is in thermal communication with the LED module such that the controller may read the temperature of the LED module. The controller may activate the fan and/or the heater depending on the temperature of the LED module.

The present disclosure further includes a method for maintaining the temperature of an LED module within prescribed limits including the steps of:

a. providing a fan for cooling the LED module;

b. providing a heater for heating the LED module;

c. providing a controller configured to selectively activate the fan and the heater;

d. providing a temperature sensor in thermal communication with the LED module and in electrical communication with the controller;

e. in the controller, reading the temperature of the LED module;

f. activating the fan when the temperature of the LED module approaches an upper limit; and g activating the heater when the temperature of the LED module approaches a lower limit.

Further objects, features, and advantages of the present invention will be apparent to those skilled in the art upon examining the accompanying drawings and upon reading the following description of the preferred embodiments.

DESCRIPTION OF THE PREFERRED EMBODIMENTS

Before explaining the present invention in detail, it is important to understand that the invention is not limited in its application to the details of the construction illustrated and the steps described herein. The invention is capable of other embodiments and of being practiced or carried out in a variety of ways. It is to be understood that the phraseology and terminology employed herein is for the purpose of description and not of limitation.

Figure 1:
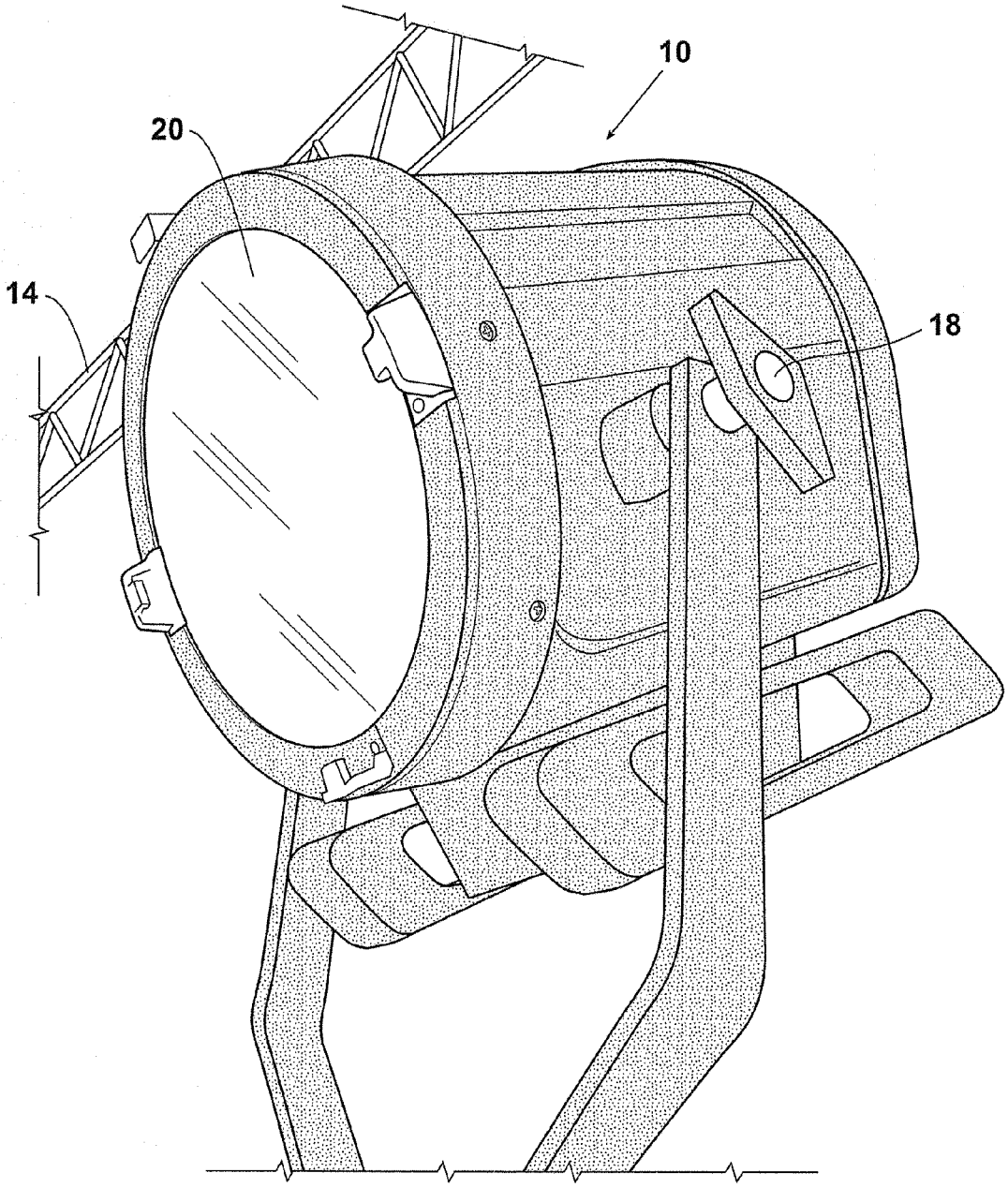
FIG. 1 depicts a preferred embodiment of the inventive system for heating an LED device in its general environment.

Referring now to the drawings, wherein like reference numerals indicate the same parts throughout the several views, one embodiment of a high power LED video production light employing the present invention 10 is shown in its general environment in FIG. 1. Typically fixture 10 is pivotally mounted to a stand 12, or perhaps a truss 14, by a bail, or yoke, 16. Mount 16 allows fixture 10 to be tilted up or down and locked in place with knob 18 (a second knob is typically provided on the opposite side of the lighting instrument, but not shown). Between the stand mounting and yoke 16, the light can generally be directed as desired.

In one preferred embodiment, LED fixture 10 includes a Fresnel lens 20 located towards the front of the instrument to allow focusing of the beam. As will be discussed in more detail below, the LED may be moved relative to lens allowing adjustment of the width of the beam.

Figure 2:
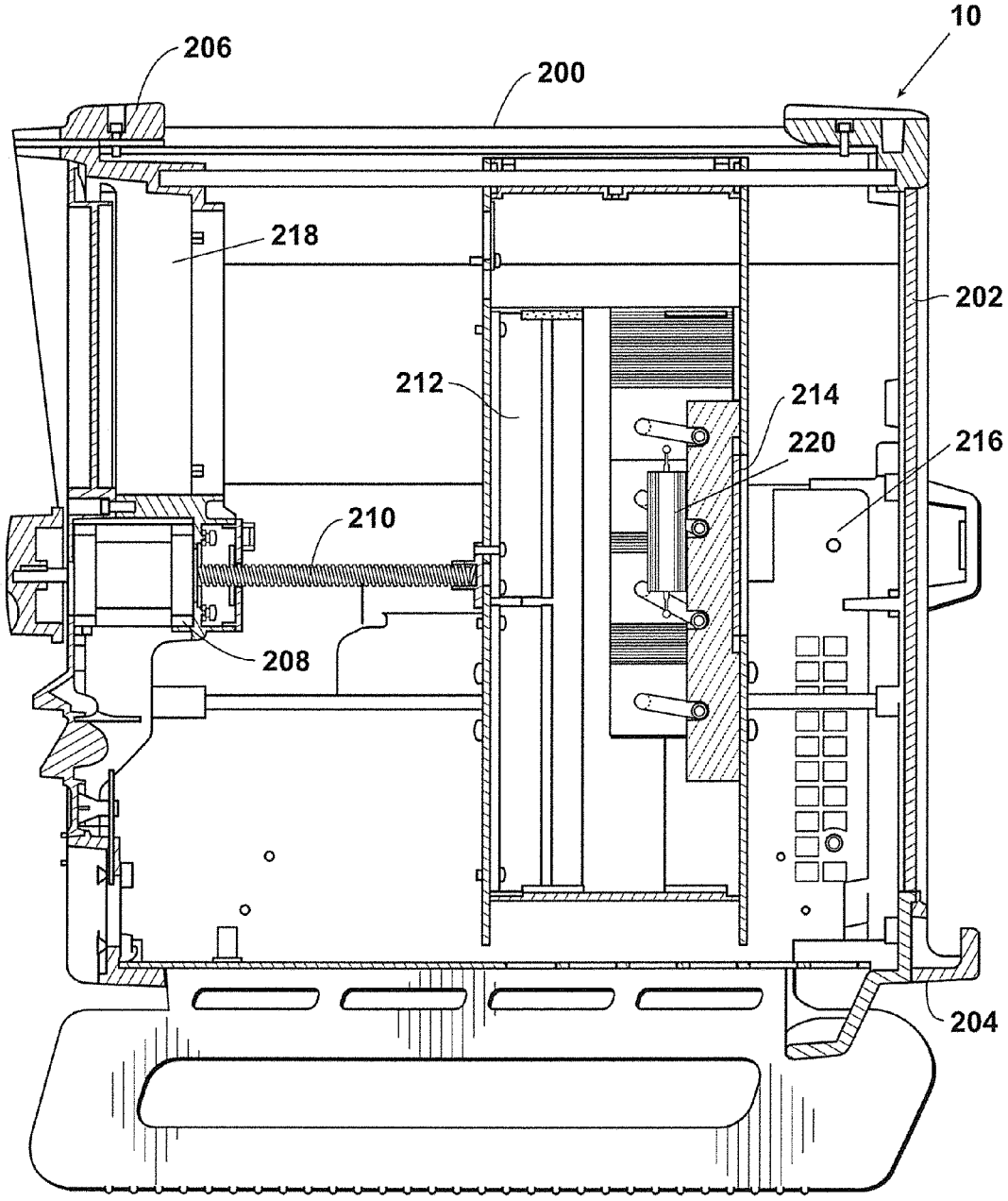
FIG. 2 provides a cutaway view from the right side to show the interior of the fixture of FIG. 1.

While many of the features of a particular LED lighting instrument are not important to practicing the present invention, for the sake of clarity, a brief discussion of the construction of a typical LED fixture suitable for use with the present invention is provided. Turning to FIG. 2, LED fixture 10 includes: a housing 200; Fresnel lens 202 retained in front cover 204 at a forward end of housing 200; a rear cover 206 covering the back of housing 200; a stepper motor 208 mounted in rear cover 206 for driving lead screw 210; a heat sink 212 includes a threaded nut 214 driven by lead screw 210 to move the heat sink forward and backward within the housing as screw 210 is driven by motor 208, thereby focusing the light exiting the fixture. As will be apparent to one of ordinary skill in the art, while the focusing mechanism is described as employing a stepper motor 208 and lead screw 210, virtually any type of mechanism for moving heat sink 212 would suffice as long as heat sink 212 can be accurately positioned. Such mechanisms include purely manual systems and/or automated systems (i.e., servo driven systems).

Figure 3:
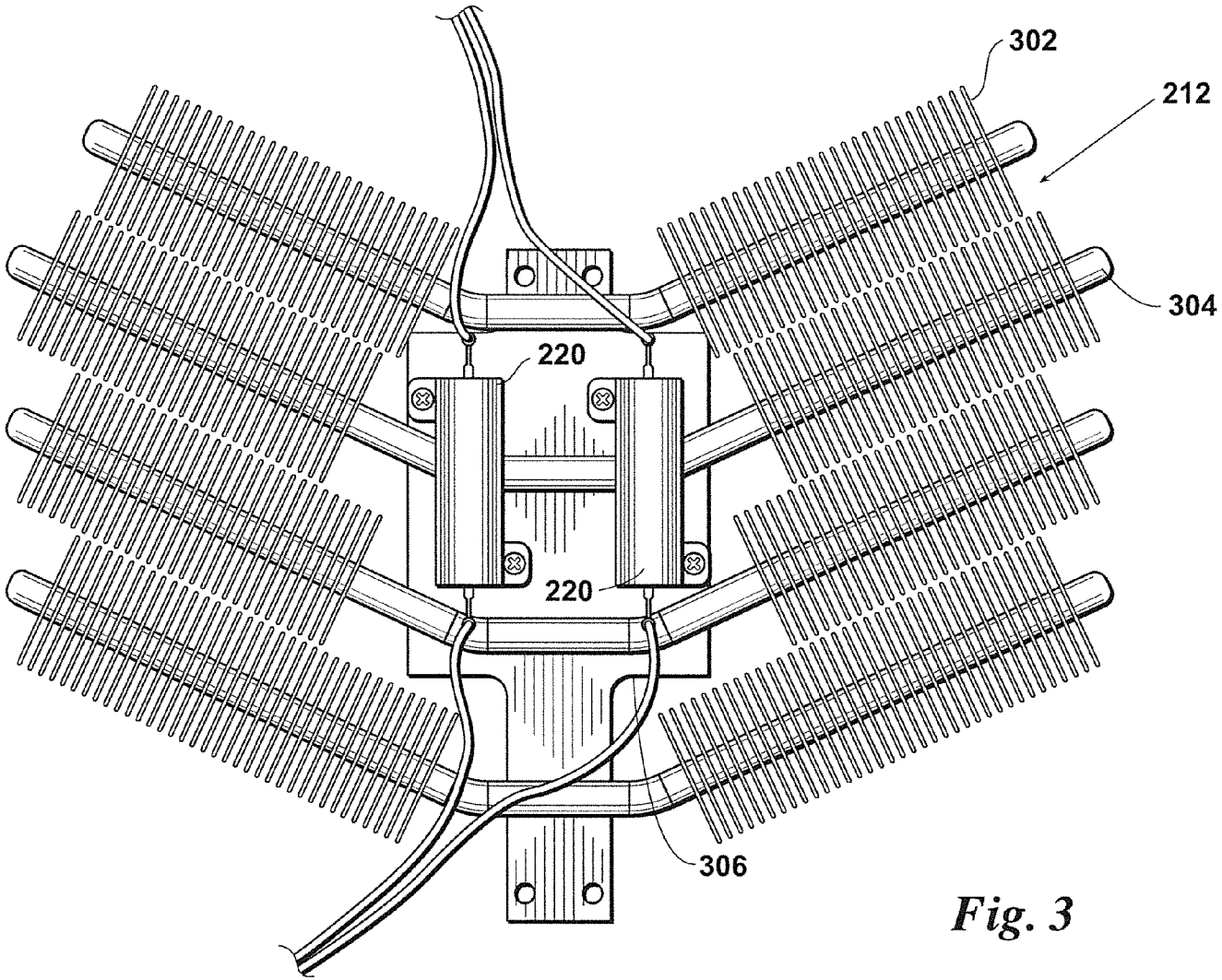
FIG. 3 provides a rear view of a preferred embodiment of a heat sink as used in the fixture of FIG. 1.

Mounted to the forward surface of heat sink 212 is LED module 214. LED module 214 is preferably a chip-on-board ("COB") module. One such module is a VERO 29 LED module manufactured by Bridgelux, Inc. of Livermore, Calif. Chip-on-board technology involves attaching a semiconductor die directly to a circuit board. Very small bond wires are then attached directly to the die and to pads on the circuit board. Chip on board technology is a mature process relative to semiconductors in general, but is a relatively new process and still evolving as to LED modules. Heat sink 212 transfers heat from LED 214 to dissipate the heat into the environment. A fan 218 circulates air through fins (as best seen in FIG. 3) of heat sink 212 and exhausts the heated air from housing 200. Preferably fan 218 is thermostatically controlled so that the speed of the fan is no higher than it needs to be to achieve adequate cooling of LED 214 in light of the brightness of LED 214 and the ambient temperature, and thus produce no more noise than is absolutely necessary.

Circuit board 216 includes circuitry for driving LED 214, for controlling the brightness of LED 214, and for controlling the speed of fan 218. As will be apparent to one skilled in the art, fan 218 may be driven at a speed relative to the brightness of LED 214, or alternatively, a temperature sensor may be mounted near LED module 214 and the circuitry of board 216 may monitor the temperature and control fan 218 to maintain the temperature within a prescribed range, typically in neighborhood of 65 degrees Celsius.

When LED 214 is driven at less than full brightness, but with sufficient power to require some fan cooling, the temperature of LED 214 can be controlled within a fairly narrow range, typically within a 20 degree Celsius window. In a preferred embodiment, the desired temperature range is between approximately 55 degrees Celsius and approximately 75 degrees Celsius. However, it is understood that as LED technology provides LEDs that are designed to operate at higher temperatures, one skilled in the art would recognize that the desired range would increase and/or move upward. While the precise point at which the fan is stopped will vary based on the efficiency of the heat sink, particulars of the housing, the ambient temperature, etc., at some point, about 10% of full power in the preferred embodiment, the temperature of LED module 214 will fall outside the prescribed range even with fan 218 stopped. There are several reasons that it is desirous to maintain the LED temperature within a prescribed range such as, by way of example and not limitation: stable color temperature, stable forward voltage of the LED, reduced temperature cycling on the LED dies, improved life of the module, etc. To achieve temperature control when LED 214 is inactive or driven at a power level below that which allows temperature regulation via fan 218, heater 220 may be driven to add additional heat to heat sink 212. In a basic embodiment, heater 220 may be driven to add additional heat directly to the LED module 214. Circuitry on board 216 provides on/off control of power for heater 220. Proportional control of heater 220 may be provided, but simple on/off control can easily be used to control the temperature of LED 214 within a reasonable range.

Turning to FIG. 3, heat sink 212 preferably includes a body 306 for mounting LED 214 (FIG. 2) and heaters 220; one or more heat tubes 304 for conducting heat away from body 306; and a plurality of fins 302 for dissipating the heat into the environment. In a preferred embodiment, heaters 220 are electrical resistors. While resistors are available in a variety of shapes, sizes, package types, etc., any package which allows good heat transfer to body 306 would be acceptable. Further, the power rating of the resistor is not critical so long as the total heat dissipation of heaters 220 is at least high enough to provide the necessary heat to maintain the LED near 65 degrees Celsius, at least in one preferred embodiment, with the LED turned off and the fan not running in a typical indoor environment. In one preferred embodiment the sum power dissipation of the heaters is approximately 10% of the rated power of the LED module.

Figures 5, 6:
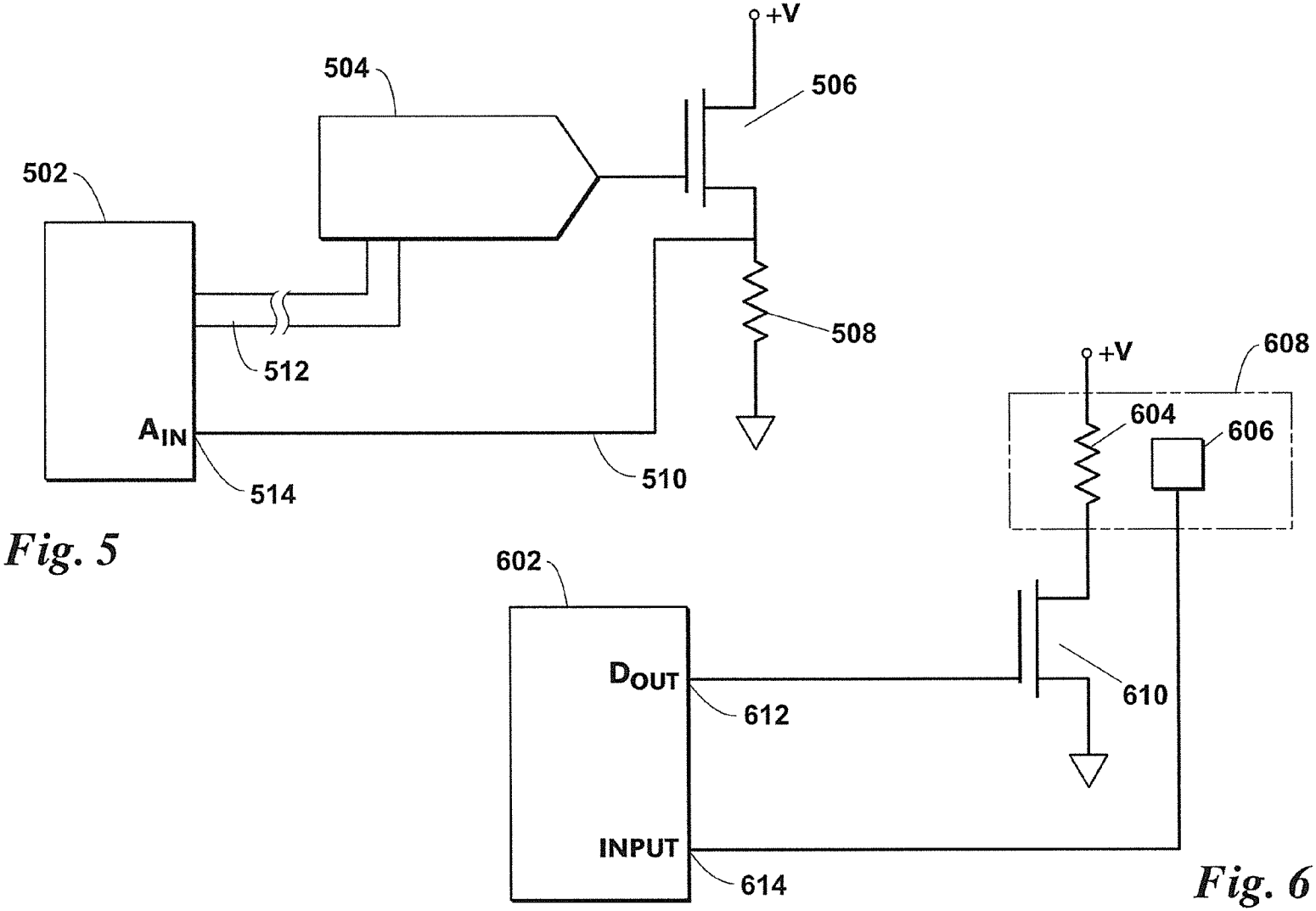
FIG. 5 provides a block diagram of a preferred embodiment which employs a MOSFET as a heater element.
FIG. 6 provides a block diagram of a preferred embodiment which employs a resistive load as a heat element.

In another preferred embodiment, a semiconductor, such as a MOSFET, can be used as the heater. FIG. 5 provides a block diagram of one such embodiment comprising: MOSFET 506; current sense register 508 for measuring the electrical current flowing through MOSFET 506; controller 502 which includes input 514 o receive a signal 510 from current sense register 508 indicative of the current flowing through MOSFET 506; and a digital to analog converter (DAC) 504 in communication with controller 514 via data bus 512 such that controller 502 can adjust the voltage provided by DAC 504 to MOSFET 506 and thus control the current flowing through MOSFET 506. When incorporated into an LED fixture, preferably a temperature sensor will be provided to measure the temperature of the LED module. Thus controller 502 can proportionately control the heat produced by MOSFET 506 to maintain the LED module temperature at a prescribed level.

In the resistive heater embodiment as discussed with reference to FIG. 3, in one preferred embodiment, thermostatic control of the heater may be accomplished through the system depicted in FIG. 6. Preferably resistive heater 604 may be switched off and on via transistor 610 under the control of output 612 of controller 602. Temperature sensor 606 provides temperature feedback to controller 602 via input 614. As will be apparent to one skilled in the art, sensor 606 can be a thermistor, or an integrated temperature sensor having a voltage output, in which case input 614 would be an analog input. Alternatively, temperature sensor 606 may provide a digital output, in which case input 614 may actually comprise a serial data bus, such as, by way of example and not limitation, a SPI bus, and ITC bus, a one wire serial bus, or the like.

Preferably heater 604 and sensor 606 are mounted on heat sink 608 proximate the LCD module. In a preferred embodiment controller 602 is a microcontroller, FPGA, or similar programmable device configured to read the temperature from sensor 606 and provide a pulse width modulated signal at output 612 to maintain a prescribed temperature at the LED module. Providing proportional control of a heat to maintain a heat sink temperature within a prescribed range within the skill level of one of ordinary skill in the art.

Figure 4:
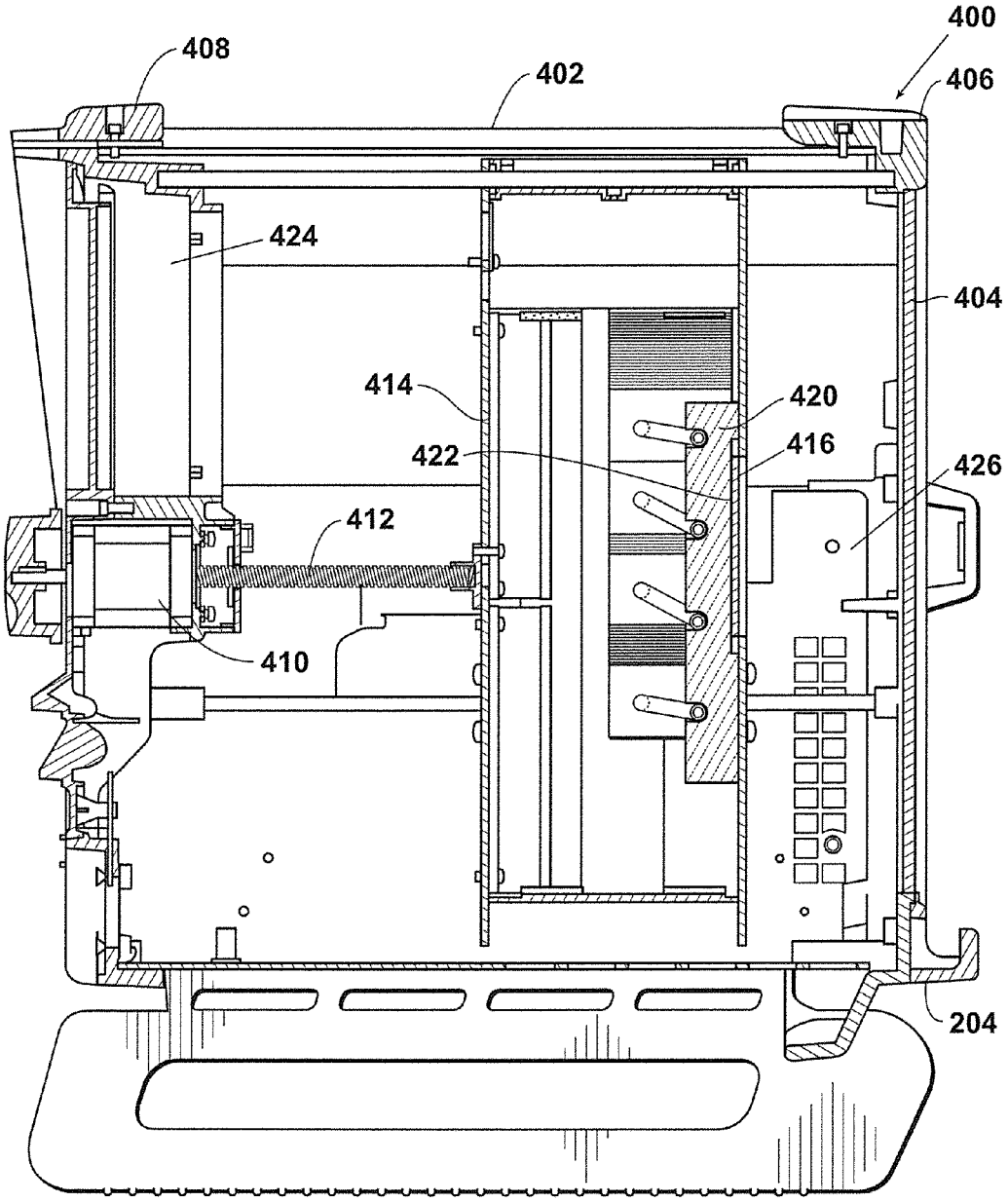
FIG. 4 depicts an LED fixture similar to that of FIG. 1 using a Peltier device to pump heat between the LED and the heat sink.

As depicted in FIG. 4, in another preferred embodiment, LED fixture 400 includes: housing 402 having a Fresnel lens 404 retained in front cover 406; a rear cover 408; a servo motor 410, such as a stepper motor, brushless DC motor, etc., mounted in rear cover 408 and configured to drive lead screw 412; a carriage assembly 414 driven by lead screw 412 so as to be positionable along a longitudinal axis extending between front cover 406 and rear cover 408.

Carriage assembly 414 includes heat sink 420 having LED module 416 attached on a forward facing surface 418 of heat sink 414 and Peltier device 422 sandwiched between heat sink 420 and LED 416. As will be apparent to one skilled in the art, the light emitted by LED 416 can selectively focused by adjusting the position of carriage 414 relative to lens 404.

A fan 424 mounted in rear cover 408 draws air through heat sink 420 and exhausts the heated air from housing 402. When electrical current is driven through a Peltier device in a first direction, one surface of the Peltier device will get cooler while the opposite surface will get hotter. Thus, a Peltier device acts as a solid state heat pump. As will be apparent to one skilled in the art, Peltier device 422 can be used to cool LED module 416 when the LED is operating and allow heat sink 420 to heat to a much higher temperature than would be possible without Peltier device 422 thus allowing heat sink 420 to dissipate heat more efficiently. When the LED 416 is driven at low power, or not at all, the current through Peltier device 422 can be reversed to heat the LED 416.

As in the previously described embodiment, the fan speed can be varied to assist cooling the LED 416, and can be stopped entirely when the Peltier device 422 is used to warm the LED 416. Methods for reversing electrical current are well known in the art, such as with an H-bridge driver which may be located on circuit board 426.

It should be noted that while preferred embodiments of the inventive LED heater have been discussed as employed in a Fresnel-type LED fixture, the invention is not so limited. The inventive techniques may be used in any type of LED fixture where stable color temperature is important over a range of operating conditions or where life of the LED may be adversely affected by temperature variations or temperature cycling. It should also be noted that while the preferred embodiments have discussed using either resistive heat or a Peltier device to produce heat, the invention is also not so limited. Any method of producing could be used including, but not limited to, combustion, friction, and the like.

Finally it should be noted that, while the preferred embodiment of the inventive LED heater system have been shown and described as incorporating a fan, the invention is not so limited. The inventive system would work equally well with convection cooled LEDs.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention.

What is claimed is:

1. An LED fixture comprising:

a housing;

a heat sink supported by said housing;

a chip-on-board LED module in thermal communication with said heat sink;

said chip-on-board LED module capable of being dimmed; and a heater in thermal communication with said chip-on-board LED module wherein when said chip-on-board LED module is dimmed, said heater can be driven to add heat to said chip-on-board LED module.

2. The LED fixture of claim 1 further including means for controlling said heater.

3. The LED fixture of claim 1 wherein said heater is controllable.

4. The LED fixture of claim 1 wherein said heater is a resistor.

5. The LED fixture of claim 1 wherein said heater is a semiconductor.

6. The LED fixture of claim 5 wherein said semiconductor is a MOSFET.

7. The LED fixture of claim 1 further including a Fresnel lens supported from said housing.

8. The LED fixture of claim 1 wherein said heater adds heat to said heat sink.

9. The LED fixture of claim 1 wherein said heater adds heat directly to said chip-on-board LED module.

10. The LED fixture of claim 4 further comprising a controller having a pulse width modulated output and a transistor for switching the electrical current through said resistor, said pulse width modulated output drivingly connected to said transistor, wherein in said controller proportionately controls the heat produced by said resistor.

11. A method for reducing the thermal cycles of a chip-on-board LED module by maintaining the temperature of the chip-on-board LED module within prescribed limits, the method including the steps of:

a. providing a fan for cooling the chip-on-board LED module;

b. providing a heater for heating the chip-on-board LED module;

c. providing a controller configured to selectively activate and deactivate said fan and said heater;

d. providing a temperature sensor in thermal communication with said chip-on-board LED module and in electrical communication with said controller;

e. in the controller, reading the temperature of the chip-on-board LED module;

f. activating said fan when the temperature of the chip-on-board LED module approaches an upper limit, g. activating said heater when the temperature of the chip-on-board LED module approaches a lower limit so as to reduce the thermal cycles of said chip-on-board LED module;

wherein said chip-on-board LED module is capable of being dimmed and wherein said heater is activated when the chip-on-board LED module is inactive or dimmed in order to maintain the chip-on-board LED module at a temperature below the lower limit.

* * * * *